US005718206A

United States Patent [19]

Sawada et al.

[11] Patent Number: 5,718,206

[45] Date of Patent: Feb. 17, 1998

[54] FUEL SUPPLY SYSTEM HAVING FUEL RAIL

[75] Inventors: Yukio Sawada, Anjo; Yukio Mori, Nagoya; Tsuyoshi Usami; Masaki Akutagawa, both of Kariya, all of Japan

[73] Assignee: Nippondenso Co., Ltd., Kariya, Japan

[21] Appl. No.: 723,426

[22] Filed: Sep. 30, 1996

[30] Foreign Application Priority Data

Oct. 12, 1995 [JP] Japan ..... 7-264169
Oct. 12, 1995 [JP] Japan ..... 7-264170

[51] Int. Cl.[6] ..... F02M 37/04

[52] U.S. Cl. ..... 123/470; 123/456; 251/129.14

[58] Field of Search ..... 123/456, 468, 123/469, 470, 472; 251/129.14

[56] References Cited

U.S. PATENT DOCUMENTS

| | | | |
|---|---|---|---|
| 3,865,312 | 2/1975 | Lombard | 251/129.14 |
| 4,308,890 | 1/1982 | Saito | 251/129.14 |
| 4,356,980 | 11/1982 | Krauss | 251/129.14 |
| 4,844,036 | 7/1989 | Bassler | 123/470 |
| 5,154,622 | 10/1992 | Ehrentraut | 123/470 |
| 5,168,857 | 12/1992 | Hickey . | |
| 5,178,115 | 1/1993 | Daly . | |
| 5,211,149 | 5/1993 | De Grace . | |
| 5,226,391 | 7/1993 | Gras | 123/456 |
| 5,347,969 | 9/1994 | Gmelin | 123/470 |
| 5,533,478 | 7/1996 | Robinson | 123/456 |

FOREIGN PATENT DOCUMENTS

| | | | |
|---|---|---|---|
| 9013741 | 11/1990 | European Pat. Off. | 123/468 |
| 2337886 | 2/1975 | Germany | 251/129.14 |
| 55-44071 U | 3/1980 | Japan . | |
| A-56-38553 | 4/1981 | Japan . | |
| A-56-76955 | 6/1981 | Japan . | |
| A-57-206769 | 12/1982 | Japan . | |
| A-233859 | 9/1990 | Japan . | |
| A-3-26867 | 2/1991 | Japan . | |
| A-3-43660 | 2/1991 | Japan . | |

*Primary Examiner*—Carl S. Miller
*Attorney, Agent, or Firm*—Nixon & Vanderhye P.C.

[57] ABSTRACT

A fuel supply system is composed of a fuel rail, a fuel injection valve and a fuel filter. The fuel injection valve has an electromagnetic solenoid, a valve member, a valve guide member and a valve seat. A plurality of slanted fuel passages are formed in the surface of the valve guide to evacuate bubble from the fuel. The fuel rail is composed of a resinous upper case member and a resinous lower case member. The fuel injection valve is held between the upper and lower case members in the axial direction of the valve. An elastic sheet member is interposed between the upper case member and the fuel injection valve, and an elastic O-ring is disposed around the fuel injection valve to reduce stress applied to the fuel injection valve in installing the fuel rail to an engine.

10 Claims, 4 Drawing Sheets

FUEL SUPPLY SYSTEM HAVING FUEL RAIL

CROSS-REFERENCE TO RELATED APPLICATION

This application is related to and claims priority from Japanese Patent Applications H7-264169 and H7-264170, both filed on Oct. 12, 1995, the contents of which are hereby incorporated by reference.

BACKGROUND OF THE INVENTION

1. Field of the Invention

The present invention relates to a fuel supply system which supplies pressured fuel accumulated in a fuel rail into an engine by an electromagnetic fuel injection valve.

2. Description of Related Art

In U.S. Pat. No. 5,178,115 (which corresponds to Japanese Patent International Publication No. Hei 6-505077), a rectangular-plate-carrier which holds a plurality of fuel injectors is inserted into a cylindrical tube. Then, each one of the fuel injectors is inserted into one of holes formed in the tube with an O-ring. A keeper having a triangular roof is inserted into the tube to hold the carrier in the tube. In this structure, it is difficult to fix the carrier to the injectors in positions if the number of fuel injection valves increases.

In Japanese Patent Publication Laid-Open No. Hei 2-233869, fuel injection valves are held within an injection valve holder which is integrally formed with a fuel supply pipe or fuel rail. Because the fuel injection valves are held between the fuel supply pipe and an outside wall of an air-intake pipe, the fuel injection valves are subject to stress when they are installed in the intake pipe.

In U.S. Pat. No. 5,168,857, an electromagnetic coil is integrally disposed in a fuel rail of a resinous material, and valves are inserted into the fuel rail. However, the electromagnetic coil and the valves must be adjusted when they are assembled and, therefore, performance of the electromagnetic coil must be adjusted to keep high accuracy of the fuel injection, for example, by controlling voltage applied to the electromagnetic coil.

In addition, because the fuel injection valve projects from the fuel rail, a large shock or stress may be applied to the fuel injection valves when the fuel rail is installed to the air-intake manifold.

In Japanese Patent Publication No. 56-75955, an electromagnetic valve has a spherical valve member and a fuel passage formed along the whole length of the electromagnetic valve in which a spring member, an adjust pipe, a fuel filter and the like are disposed. Therefore, it is difficult to evacuate the fuel vapor.

SUMMARY OF THE INVENTION

In view of the foregoing problems of the prior art, it is an object of the present invention to provide an improved fuel supply system which is easy to install to an engine.

According to the present invention, a fuel rail comprises a first case member and a second case member, and the first and second case members hold the fuel injection valve therebetween in parallel with an axis of the fuel injection valve. Therefore, the fuel injection valves can be easily installed to the fuel rail, and the fuel rail can be installed directly to the engine.

Preferably, a connecting wire is fixed to one of the first case member and the second case member for supplying the fuel injection valves with electric power when the fuel injection valves are held by the first case member and the second case member.

Another object of the present invention is to provide a fuel supply system in which elastic material is interposed between the fuel injection valves and at least one of the first and the second case members to reduce stress applied to the injection valves from outside.

Another object of the present invention is to provide a fuel supply system in which a single fuel filter is fixed to an inlet side of the fuel rail so that foreign particles contained in the fuel can be removed regardless of the number of fuel injection valves.

A further object of the present invention is to provide a fuel supply system in which a plurality of slanted fuel passages are formed on the valve guide member to evacuate bubbles contained in the fuel to outside of the fuel injection valve. Preferably, the fuel injection valve is spherical.

BRIEF DESCRIPTION OF THE DRAWINGS

Other objects and advantages of the present invention will be more readily apparent from the following detailed description of preferred embodiments thereof when taken together with the accompanying drawings in which.

DETAILED DESCRIPTION OF PREFERRED EMBODIMENT

A preferred embodiment of the present invention is described hereinafter with reference to the accompanying drawings.

A fuel supply system in accordance with an embodiment of the present invention is described with reference to FIGS. 1 through 4.

Figure 1:
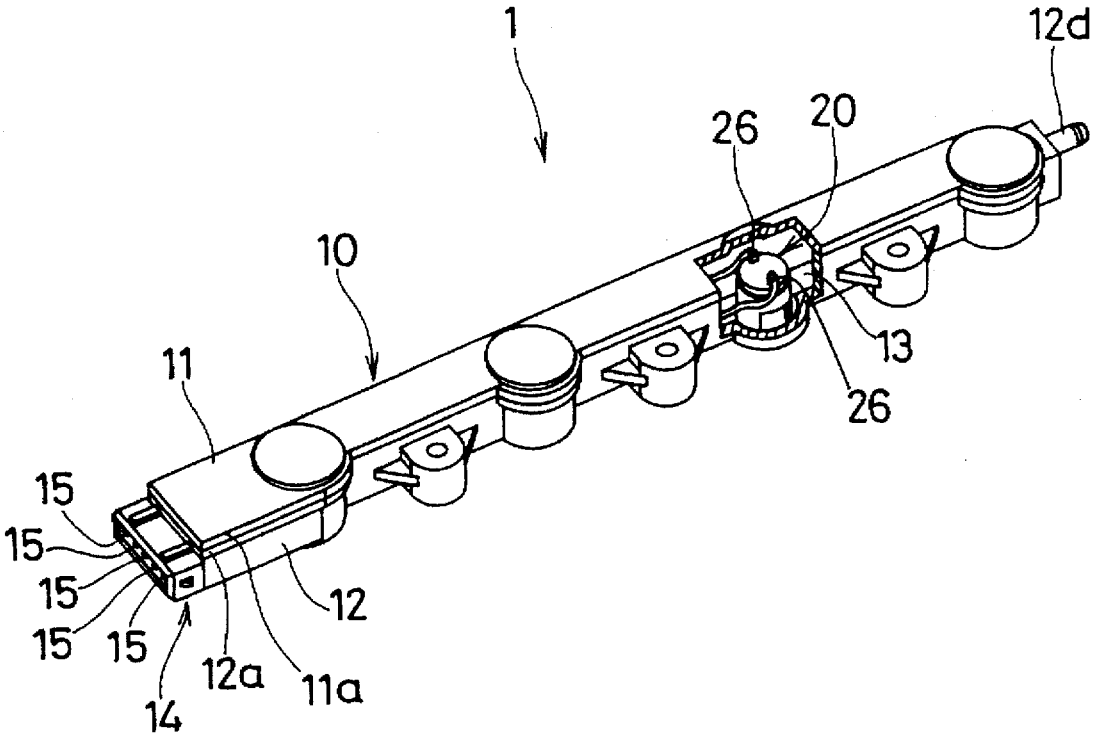
FIG. 1 is a perspective view illustrating a fuel supply system according to an embodiment of the present invention.
Figure 2:
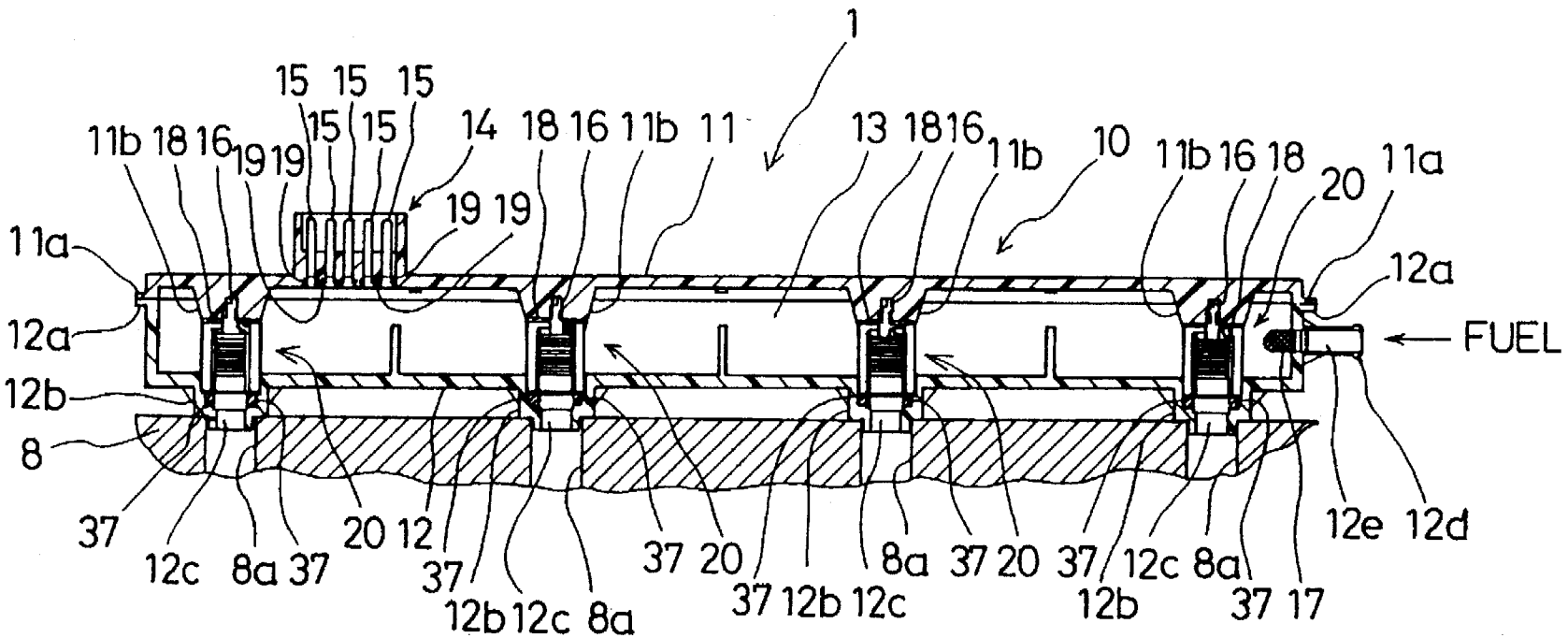
FIG. 2 is a longitudinal cross-sectional side view illustrating a main portion of a fuel supply system according to another embodiment according to the present invention.
Figure 3:
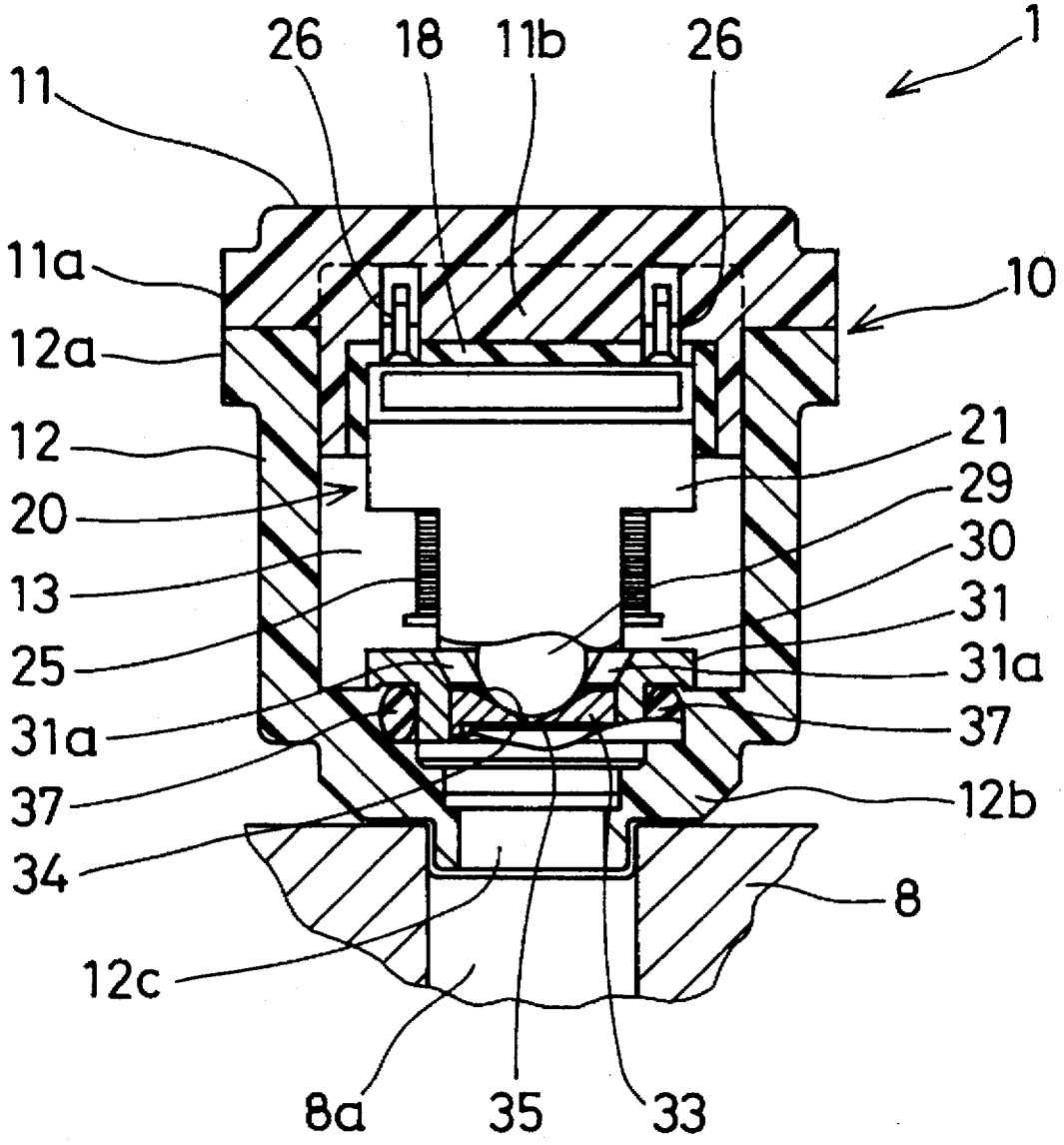
FIG. 3 is a transverse cross-sectional side view illustrating the main portion of the fuel supply system shown in FIG. 2.

As shown in FIGS. 1, 2 and 3, the fuel supply system 1 has a fuel rail 10 made of a resinous material, a plurality of fuel injection valves 20 held within the fuel rail 10, an electric connector case 14, and a fuel filter 17 for removing foreign particles from fuel in the fuel rail 10. The number of fuel injection valves 20 corresponds to the number of cylinders of an engine. Four fuel injection valves 20 are disposed to supply the fuel from the fuel rail to the engine cylinders.

The fuel rail 10 has an upper case member 11 and a lower case member 12, both made of a resinous material. A longitudinal channel is formed in the lower case member, and the upper case member 11 covers the open side of the lower case member, thereby forming a fuel supply passage 13. The connector case 14 is formed integrally with the upper side member 11 to hold therein a plurality of terminals 15. In an embodiment shown in FIG. 1 the terminals extend horizontally from the upper case member 11, while the terminals of the other embodiment shown in FIG. 2 extend upward from the upper case member through O-rings 19.

In the meantime, other portions of both embodiments are substantially the same and, therefore, description is made with respect to the other embodiment shown in FIG. 2.

The terminals 15 of both embodiments are electrically connected to respective electromagnetic fuel injection valves 20 through a wire harness disposed in the upper case member and sockets 16 located inside the upper case member 11. Presser portions 11*b* are formed integral with the inner surface of the upper case member 11, and each of the sockets 16 is supported by each of the presser portions 11*b* so as to be in contact with terminals 26 of each of the fuel injection valves 20. That is, four presser portions 11*b* are disposed in the fuel rail.

The lower case member 12 has a U-sectional shape to form a long channel at the lower portion 12 of the fuel rail 10. A flange portion 11*a* of the upper case member 11 and flange portion 12*a* of the lower case member 12 are formed to provide a wide contacting surface. A cylindrical portion 12*d* is formed at a longitudinal end of the lower case member 12 to provide a fuel inlet passage 12*e* therein. A fuel filter 17 is fixed to an inner end of the cylindrical portion 12*d* to remove foreign particles included in the fuel flowing therethrough. Therefore, only one fuel filter is necessary in this embodiment.

As shown in FIG. 3, a neck portion 12*b* is formed on the outside of the lower case member 12 at a portion where each of the fuel injection valves 20 is located. The neck portion 12*b* provides a through hole 12*c* which connects the fuel supply passage 13 with the outside of the fuel rail 10, and the fuel injection valve 20 is inserted into this through hole 12*c*. The neck portion 12*b* has such a length that a guide member 31 of the fuel injection valve 20 may not protrude from the neck portion 12*b*. That is, the fuel injection valve 20 does not project from the lower case member 12 of the fuel rail 10 to the outside when the fuel rail 10 is assembled to an intake manifold and, therefore, stress is not applied to the fuel injection valve 20. Thus, housing 21 of the fuel injection valve 20, which is made of a magnetic material, does not require a special stiffness to protect the injection valves.

Thus, the fuel injection valve 20 can be held by the upper case member 11 and lower case member 12 from opposite directions within the fuel rail 10. A sheet member 18 made of an elastic material such as rubber is interposed between the presser portion 11*b* and the fuel injection valve 20, and an elastic O-ring 37 is interposed between the guide member 31 and a circular step portion formed inside the neck portion 12*b* so that the fuel injection valve 20 can be installed into the fuel rail 10 without excessive stress.

Since the fuel rail 10 is formed from a heat-insulating resinous material and insulates the heat conducted from an engine, vapor in the fuel of the fuel rail 10 can be suppressed.

Next, the structure of the fuel injection valve 20 is described with reference to FIG. 4.

Figure 4:
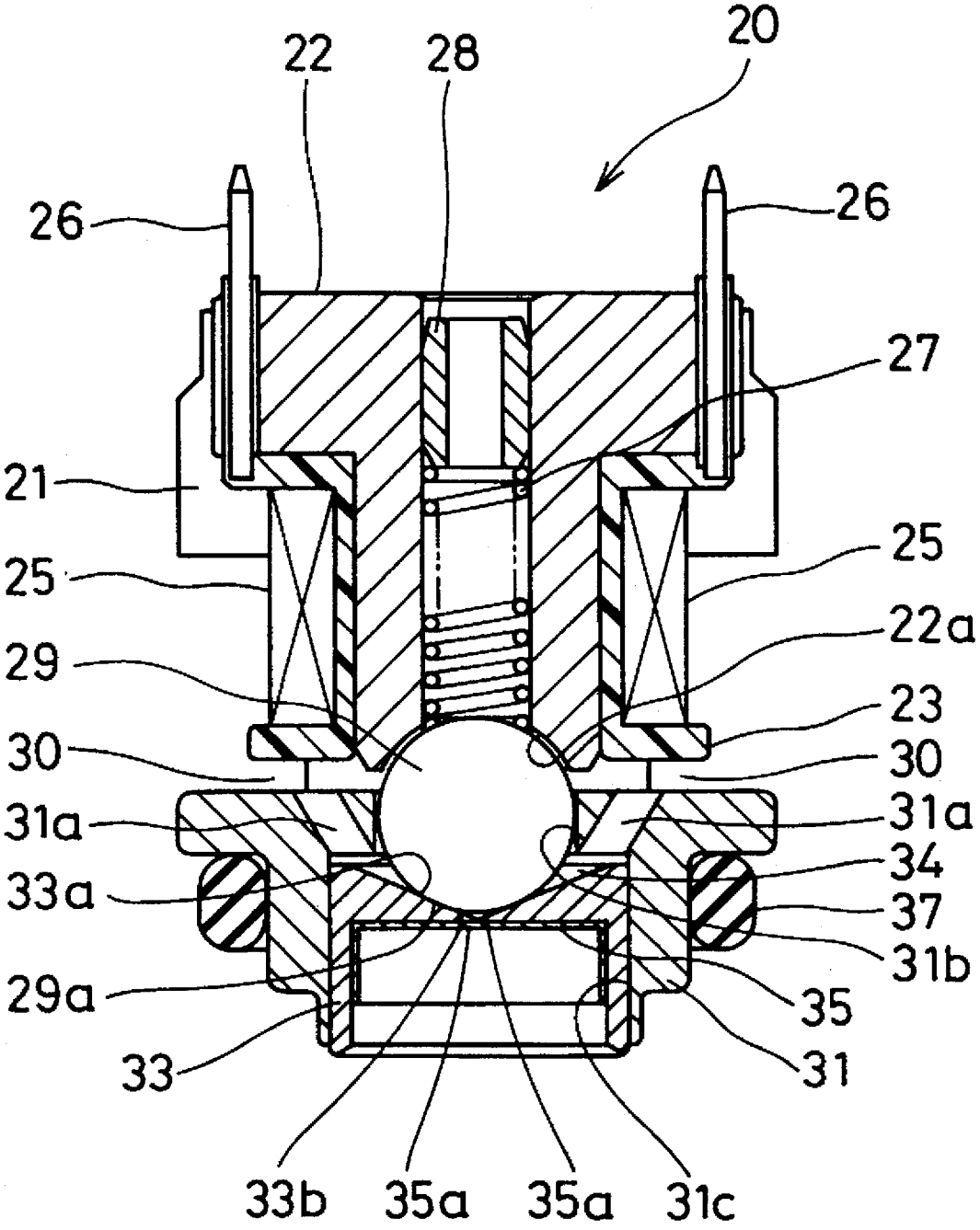
FIG. 4 is a cross-sectional side view of an electromagnetic injection valve.

As shown in FIG. 4, the fuel injection valve 20 is composed of an electric solenoid and a valve for opening and closing the fuel passage.

The electric solenoid has a cylindrical ferromagnetic yoke member 22 having a large-diameter portion and a small-diameter portion or a T-shape-longitudinal-section, a bobbin 23 which has flat flange portion and is disposed around the small-diameter portion of this magnetic yoke member 22, a coil 25 turned around the bobbin 23, two terminals 26 respectively connected to opposite ends of this coil 25, a compression coil spring 27 and a pipe 28 held within an axially extending through hole formed in the center of the magnetic yoke member 22. The pipe 28 controls the compressed coil spring 27. A bowl-shaped concave 22*a* is formed on the bottom surface of the yoke member 22 around the through hole for the compressed coil spring 27. The concave 22*a* provides a wide surface facing a spherical surface 29*a* of a spherical valve member 29. Thus, a wide circular space is formed between the concave 22*a* of the magnetic yoke member 22 and the spherical valve member 29.

The fuel injection valve 20 is composed of the guide member 31 which is generally cylindrical and has a flange portion or a T-shaped longitudinal cross-section, a cylindrical seat member 33 held within a center hole 31*c* of the guide member 31, the spherical valve member 29 which is seated on a surface 33*a* of the seat member 33, a cylindrical plate 35 having a valve hole 35*a* and the O-ring 37. A fuel supply port 30 is formed between the bobbin 23 of the coil 25 and the flange portion. The guide member 31 is integrally formed with the housing 21.

The guide member 31 has a guiding hole 31*b* formed at the flange portion (upper portion) to have a diameter a little larger than the valve member 29, a hole portion 31*c* formed at the lower portion thereof to have a diameter larger than the seat member 33. That is, the holes 31*b* and 31*c* are formed throughout the guide member 31.

A plurality of slanted fuel passages 31*a* is formed to connect the fuel supply channel 30, which is disposed an upper side (a side having higher potential energy) of the fuel passages in the valve, with a circular passage 34 (which is described later) in the upper portion of the guide member 31 as shown in FIG. 4. The slanted passages 31*a* extend downward (to a side having lower potential energy) from an upper surface of the flange portion of the guide member 31*a* radially outside the hole portion 31*c* to an inside surface of the flange portion radially inside the hole portion 31*c* so that the vapor included in the fuel can go up and outward along the slanted fuel passages 31*a* and can be quickly discharged from the supply channel 30 to the outside. Because the fuel passage 31*a* are slanted, the guide member 31 can receive the spherical valve member 29 with a small and even circular clearance at the whole circumference. Thus, the spherical surface 29*a* of the valve member 29 and the inner surface of the hole 31*b* provides a wide confronting area, which increases electromagnetic force between the valve member and the magnetic yoke member 22.

The spherical valve member 29, which is made of a ferromagnetic material, reciprocates in a space between the concave 22*a* of the magnetic yoke member 22 and the seat surface 33*a* of the seat member 33 when electric power is supplied to the coil 25 of the electric solenoid.

The cylindrical seat member 33 has a thick-wall ceiling on which a tapering seat surface 33*a* is formed to receive the spherical valve member 29. A fuel passage 33*b* is formed at the center of the seat surface 33*a* to connect both sides of the seat member 33. When the valve member 29 is seated on the seat surface 33*a* as shown in FIG. 4, the fuel passage 33*b* is closed. When the valve member 29 is lifted from the seat surface 33*a*, the fuel passage 33*a* is opened to communicate between both sides of the seat member 33. The circular passage 34 is formed by the inner periphery of the hole 31*c* of the guiding member 31, the spherical surface 29*a* of the valve member 29 and the seat surface 33*a* the seat member 33 to introduce the pressured fuel therein.

The cylindrical plate 35 has a ceiling and is closely in contact with the inner surface of the seat member 33. A plurality of injection holes 35*a* are formed in the center of the ceiling of the plate 35. When the valve member 29 is lifted from the seat member 33, the fuel is injected from the injection holes 35*a*.

The O-ring 37 of an elastic member such as rubber has an inner diameter smaller than the outside diameter of the lower portion of the guide member 31 to seal spaces between the outer periphery of the lower portion of the guide member 31 and the inner periphery of the lower case member 12 of the fuel rail.

The housing 21 made of a ferromagnetic material forms a part of magnetic circuit when electric power is applied to the coil 25 of the electric solenoid.

Next, the operation of the fuel injection valve 20 is described with reference to FIGS. 2, 3 and 4.

A pressured fuel flowing from the fuel inlet passage 12*e* to the fuel supply passage 13 through the fuel filter 17 is supplied to the fuel supply channel 30, the fuel passage 31*a* and the circular passage 34 which are always communicated with the fuel supply passage 13.

When an electric voltage is applied to the coil 25 through terminals 26, magnetic flux is formed in a circuit composed of the ferromagnetic yoke member 22, the housing 21, the guide member 31, the valve member 29 and the ferromagnetic yoke member 22. A part of housing 21 (not shown) is disposed around the coil 25 to provide additional magnetic circuit. The valve member 29 is attracted to the magnetic yoke member 22 against the spring force of the spring 27 so that the valve member 29 is lifted from the seat surface 33*a* of the seat member 33. Consequently, pressured fuel passes through the circular passage 34 and flows to the fuel passage 33*b* to be injected from the injection holes 35*a*.

When an electric voltage is not applied to the coil 25, electromagnetic attraction is not generated. Accordingly, valve member 29 is biased in a direction of seat member 33 by compression coil spring 27 to seat valve member 29 on seat surface 33*a*. Thus, the communicating passage between circular passage 34 and fuel passage 33*b* is closed and fuel is not injected from the injection holes 35*a*.

Next, the steps of assembling the fuel rail 10 are described with reference to FIGS. 1 to 3.

① A specified number of the fuel injection valves 20 are temporarily fixed to the lower case member 12 of the fuel rail 10. That is, the guide member 31 is inserted into the neck portion 12*b* of the lower case member 12. The O-ring 37 is put on around the lower portion of the guide member 31.

② A specified number of the terminals 15 are inserted into holes formed in the connector case 14 of the upper case member 11 with the O-rings 19. Then, a wire harness is electrically connected to the terminals 15 at one end and to the socket 16 at the other end which is inserted and molded to the presser portion 11*b* of the upper case member 11.

③ The fuel filter 17 is inserted into or bonded to the downstream portion of the cylindrical portion 12*d*.

④ The sheet member 18 is fixed to a portion adjacent to the terminals 26 which is temporarily fixed in the above-described step ①.

⑤ The upper case member 11, the flange portion 12*a* of the lower case member 12 and the flange portion 11*a* of the upper case member 11 are welded or bonded together so that the presser portions 11*b* of the upper case member 11 press the fuel injection valves 20 against the lower case member 12. Consequently, the sockets 16, which are molded in the presser portions 11*b* of the upper case member 11, are coupled and electrically connected with terminals 26 of fuel injection valves 20.

Thus, the fuel injection valves 20 are held by the upper case member 11 and the lower case member 12 in the axial direction so that the fuel injection valves 20 can be easily assembled to the fuel rail 10.

Since the fuel injection valves 20 are installed and electrically connected to the sockets 16, the fuel supply system can be easily installed to an intake manifold 8.

The present invention having been described should not be restricted to the above described embodiments but may be modified in many other ways without departing from the spirit of the invention.

What is claimed is:

1. A fuel supply system comprising:

a plurality of fuel injection valves;

a fuel rail having an upper case member with pressor members supporting upper portions of said injection valves and a lower case member having neck portions supporting lower portions of said fuel injection valves;

wherein each of said fuel injection valve comprises:

a housing having a fuel port fixed to one of said pressor members, a valve guide member having a guiding hole, a center hole and a fuel passage which connects said fuel port to said center hole, said guide member being disposed under said fuel port and fixed to one of said neck portions, a valve seat having an injection hole and disposed under said valve guide member, a valve member held within said guiding hole for closing said injection hole when said valve member is seated on said valve seat, biasing means, disposed in said housing, for biasing said valve member against said valve seat, and an electric solenoid coil, disposed in said housing, for lifting said valve member when electric power is applied thereto.

2. A fuel supply system comprising:

a vertical fuel injection valve;

a fuel rail having an upper case member with a pressor member inside said fuel rail supporting an upper portion of said injection valve and a lower case member having a neck portion inside said fuel rail supporting a lower portion of said fuel injection valve;

wherein said fuel injection valve comprises a housing having a fuel port held by said pressor member, a magnetic yoke member fixed to said housing and having a through hole therein, a valve guide member having a guiding hole, a center hole and a fuel passage which connects said fuel port to said center hole, said guide member being disposed under said fuel port and fixed to one of said neck portion, a valve seat having an injection hole and disposed under said valve guide member, a valve member held within said guiding hole for closing said injection hole when said valve member is seated on said valve seat, biasing means, disposed in said through hole of said yoke member, for biasing said valve member against said valve seat, and an electric solenoid coil, wound on said yoke member, for lifting said valve member when electric power is applied thereto.

3. A fuel injection valve as in claim 2, wherein said electric solenoid coil has a coil bobbin having a flat flange, and said fuel port is disposed between said guide member and flat flange of said coil bobbin.

4. A fuel injection valve comprising:

a housing made of magnetic material and having a fuel port, a valve guide member, disposed under said fuel port, said valve guide member having a guiding hole, a center hole disposed under said guiding hole and a fuel passage connecting said fuel port and said center hole;

a valve seat disposed under said valve guide member and having a tapering seat surface and an injection hole;

a valve member held within said guiding hole, said valve member closing said injection hole when said valve member is seated to said valve seat;

biasing means for biasing said valve member against said valve seat; and an electric solenoid coil for lifting said valve member when electric power is applied thereto;

wherein said fuel port is located radially outside said guiding hole, said fuel passage is slanted to extend from said fuel port down to open to said center hole; and a circular passage connected to said fuel passage is defined by said guiding member, said valve member and said seat surface of said seat member.

5. A fuel supply system as in claim 1, wherein said upper case member has a longitudinal channel;

a lower case member covering said longitudinal channel to form a fuel passage and a fuel inlet; and said fuel injection valve has a fuel supply channel connected to said fuel passage.

6. A fuel supply system as in claim 5 further comprising an electric wire fixed to one of said upper and said lower case members for supplying an electric power to said fuel injection valve.

7. A fuel supply system as in claim 5 further comprising an elastic sheet member disposed between said fuel injection valve and at least one of said upper case member and said lower case member.

8. A fuel supply system as in claim 5 further comprising a fuel filter disposed in said fuel passage and fixed to said fuel inlet.

9. A fuel injection valve as in claim 4, wherein said electric solenoid coil comprises a coil bobbin having a flat flange, and said fuel port is disposed between said guide member and flat flange of said coil bobbin.

10. A fuel injector valve as in claim 9, wherein said valve member comprises a spherical magnetic member.

* * * * *